United States Patent [19]

Ohmura

[11] Patent Number: 4,916,815

[45] Date of Patent: Apr. 17, 1990

[54] SHEATHED SCISSORS

[75] Inventor: Ryuichi Ohmura, Shizuoka, Japan

[73] Assignee: Fuji Kogyo Co., Ltd., Shizuoka, Japan

[21] Appl. No.: 522,263

[22] Filed: Aug. 11, 1983

[30] Foreign Application Priority Data

Oct. 18, 1982 [JP] Japan ..... 57-157215[U]

[51] Int. Cl.[4] ..... B26B 3/06

[52] U.S. Cl. ..... 30/151

[58] Field of Search ..... 30/151, 152, 164, 29, 30/122; 132/75.4, 75.5

[56] References Cited

U.S. PATENT DOCUMENTS 2,466,898 4/1949 Johnson ..... 30/151

FOREIGN PATENT DOCUMENTS 7011 of 1896 United Kingdom ..... 30/151

*Primary Examiner*—Douglas D. Watts

*Attorney, Agent, or Firm*—Wegner & Bretschneider

[57] ABSTRACT

Sheathable scissors including a pair of scissors members pivoted at their center and having a blade end and a handle end. There is a step between the handle and the blade, down to the blade, and an engaging lug is formed along the step. The sheath for receiving the blades includes a recessed opening and has a thickness, at the opening, equal to the height of the steps so that, when the blades are inserted into the sheath, the surface of the sheath is smoothly contiguous to the surfaces of the handles.

2 Claims, 3 Drawing Sheets

SHEATHED SCISSORS

DETAILED DESCRIPTION OF THE INVENTION

The present invention relates to sheathed scissors comprising a novel combination of blades and a sheath, which is designed especially in view of the appearance of the scissors when they are sheathed, and intended to be made safer through visual identification.

More specifically, the present invention provides a combination of scissors and an associated sheath. A pair of scissors members is pivoted at its center, each having one portion adapted to serve as a blade and the other portion as a handle. The handle is stepped down toward the blade. The associated sheath includes an opening where its thickness is equal to the height of the step. Male-female engaging means is provided on the interfaces of the handles and the sheath.

When the scissors are sheathed, the surface of the sheath is smoothly contiguous to the surface of the scissors, and the sheath engages resiliently with the scissors.

The present invention will now be explained in detail with reference to one embodiment illustrated in the drawings, in which.

Figure 1:
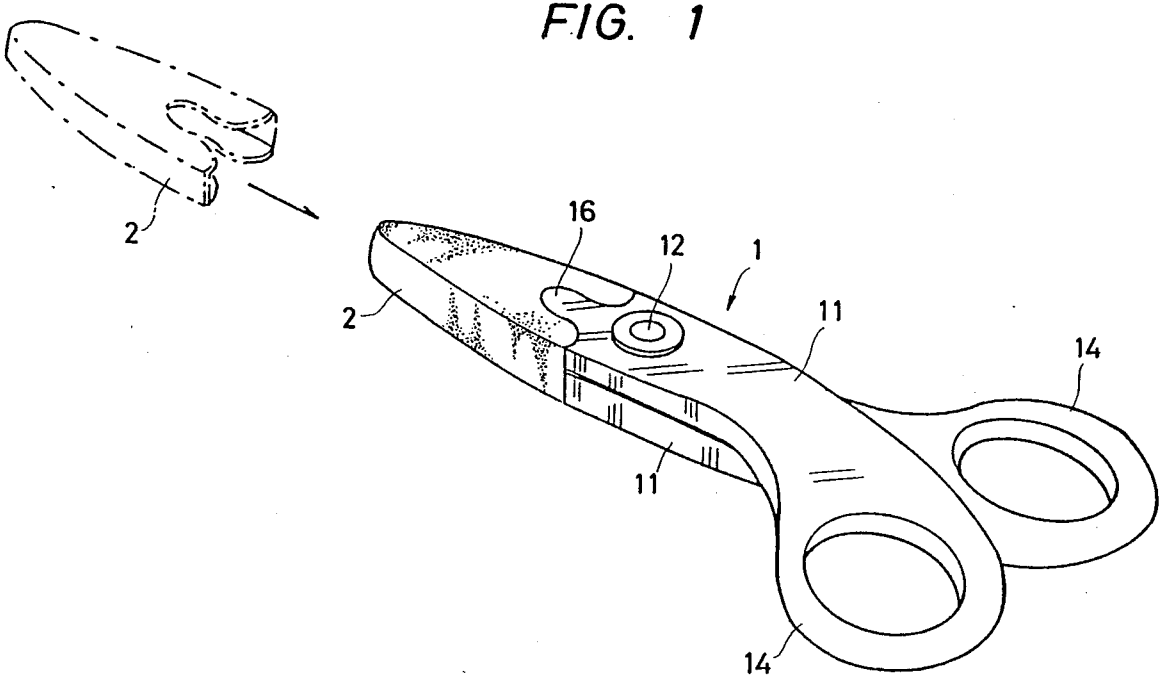
FIG. 1 is a perspective view of the sheathed scissors according to the present invention.
Figure 2:
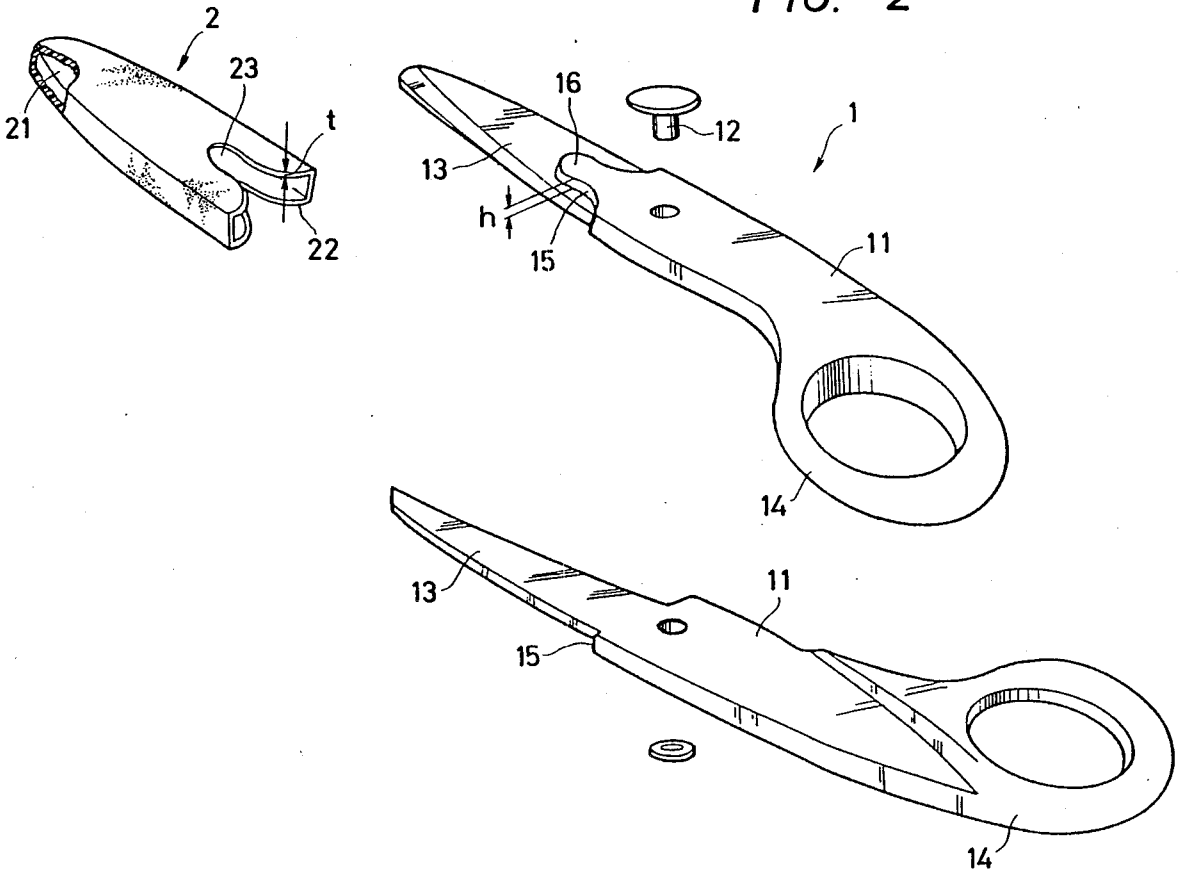
FIG. 2 is an exploded perspective view of that embodiment.
Figure 3:
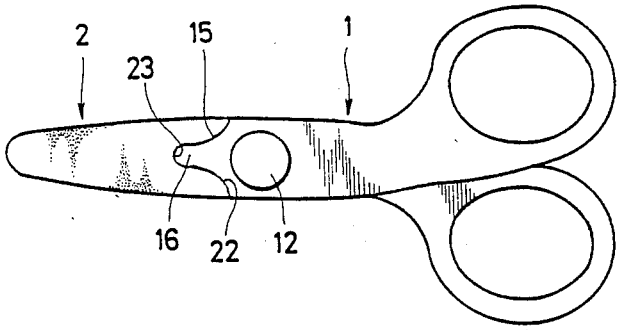
FIG. 3 is a side view of that embodiment.
Figure 4:
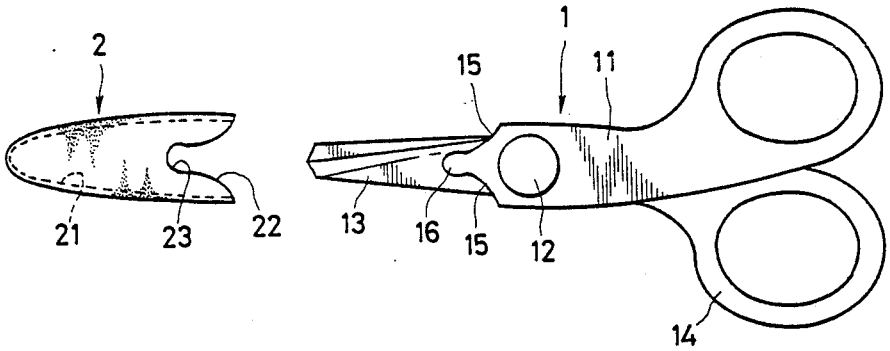
FIG. 4 is a side view of the scissors members from which the sheath has been removed.
Figure 5:
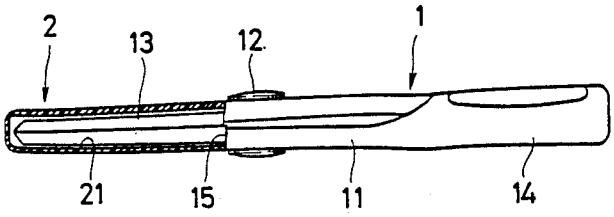
FIG. 5 is a partly cut away plan view of the scissors sheathed.

In the drawings, there is shown a combination of scissors 1 and a sheath 2. Referring first to the scissors 1, a pair of scissors members 11 is pivoted at its center with pivot 12 in a manner known in the art. In the embodiment illustrated, the scissors members 11 are shown to be identical in shape with each other. The scissors members 11 each have one portion adapted to serve as a blade 13 and another portion as a handle 14. The handles 14 are stepped down at 15 toward the blades 13.

In the vicinity of the steps 16 there are a pair of engaging means 16. Each engaging means 16 extends from the step 15 toward the blade end of the blade on the upper face of each blade 13, with its distal end being rounded.

On the other hand, the sheath 2 is formed of an elastic material such as plastic, and is made hollow as shown at 21 so that it receives blades 13 of the scissors 1. At opening 22 of the sheath 2, recess 23 is formed, corresponding to the engaging means 16 of the scissors 1. The thickness t of the sheath 2 at the opening 22 is substantially equal to the height of the step 15 of the scissors 1.

When the blades 13 of the scissors 1 are accommodated into the hollow portion 21 of the sheath 2, and the engaging means 16 of the scissors members 11 engage resiliently with the recesses 23 in the sheath 2, the periphery of the sheath 2 is smoothly contiguous to the surfaces of the scissors.

Thus, the present invention is designed to look awkard without the sheath, thus reminding the user not forget and lose the associated sheath.

What is claimed is:

1. Sheathable scissors comprising a pair of scissors members pivotally joined to form a pair of handles at one end and a pair of juxtaposed blades at the other end, each of said scissors members comprising a handle portion and a blade portion and having an inner surface serving as a bearing surface, and outer surfaces, said handle portion being stepped down to said blade portion at the outer surfaces, said handle portion including an engaging lug projecting into the blade portion for engaging a corresponding slot in a sheath, said step having a height approximately equal to the thickness of said sheath.

2. In combination, scissors as defined in claim 1, and a sheath, said sheath having a length approximately equal to the length of said blade portions, having an engaging slot at one end to snugly engage said lug, having a thickness at said one end approximately equal to the height of said step, and having a shape equal to the shape of said juxtaposed blades, whereby, when said scissors and said sheath are assembled, the outer surfaces thereof are continuous.

* * * * *